US007735980B2

(12) United States Patent
Xu et al.

(10) Patent No.: US 7,735,980 B2
(45) Date of Patent: Jun. 15, 2010

(54) FLUID FLOW DEVICE FOR A PRINTING SYSTEM

(75) Inventors: Jinquan Xu, Rochester, NY (US); Zhanjun Gao, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 487 days.

(21) Appl. No.: 11/746,104

(22) Filed: May 9, 2007

(65) Prior Publication Data

US 2008/0278550 A1 Nov. 13, 2008

(51) Int. Cl.
*B41J 2/09* (2006.01)

(52) U.S. Cl. ..... 347/77

(58) Field of Classification Search ..... 347/77, 347/73–76, 78–83

See application file for complete search history.

(56) References Cited

U.S. PATENT DOCUMENTS 4,068,241 A 1/1978 Yamada
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
2004/0095441 A1 5/2004 Jeanmaire

FOREIGN PATENT DOCUMENTS

EP 1 407 885 4/2004

*Primary Examiner*—K. Feggins
(74) *Attorney, Agent, or Firm*—William R. Zimmerli

(57) ABSTRACT

A printing system and method of printing are provided. The system includes a liquid drop ejector operable to eject liquid drops having a plurality of volumes along a first path. A fluid flow source is operable to produce a first fluid flow that interacts with the liquid drops to cause liquids drops having one of the plurality of volumes to begin moving along a second path. A fluid flow source is operable to produce a second fluid flow. The second fluid flow including a flow component substantially parallel to the first path.

30 Claims, 8 Drawing Sheets

FLUID FLOW DEVICE FOR A PRINTING SYSTEM

CROSS REFERENCE TO RELATED APPLICATIONS

Reference is made to commonly-assigned, U.S. patent application Ser. No. 11/746,117, filed currently herewith, entitled "A FLUID FLOW DEVICE AND PRINTING SYSTEM," and U.S. patent application Ser. No. 11/746,094, filed currently herewith, entitled "PRINTER DEFLECTOR MECHANISM INCLUDING LIQUID FLOW."

FIELD OF THE INVENTION

This invention relates generally to the management of fluid flow and, in particular to the management of fluid flow in printing systems.

BACKGROUND OF THE INVENTION

Printing systems incorporating a gas flow are known, see, for example, U.S. Pat. No. 4,068,241, issued to Yamada, on Jan. 10, 1978.

The device that provides gas flow to the gas flow drop interaction area can introduce turbulence in the gas flow that may augment and ultimately interfere with accurate drop deflection or divergence. Turbulent flow introduced from the gas supply typically increases or grows as the gas flow moves through the structure or plenum used to carry the gas flow to the gas flow drop interaction area of the printing system.

Drop deflection or divergence can be affected when turbulence, the randomly fluctuating motion of a fluid, is present in, for example, the interaction area of the drops that are traveling along a path and the gas flow force. The effect of turbulence on the drops can vary depending on the size of the drops. For example, when relatively small volume drops are caused to deflect or diverge from the path by the gas flow force, turbulence can randomly disorient small volume drops resulting in reduced drop deflection or divergence accuracy which, in turn, can lead to reduced drop placement accuracy.

Accordingly, a need exists to reduce turbulent gas flow in the gas flow drop interaction area of a printing system.

SUMMARY OF THE INVENTION

According to one aspect of the present invention, a printing system includes a liquid drop ejector operable to eject liquid drops having a plurality of volumes along a first path. A fluid flow source is operable to produce a first fluid flow. The first fluid flow interacts with the liquid drops to cause liquids drops having one of the plurality of volumes to begin moving along a second path. A fluid flow source is operable to produce a second fluid flow with the second fluid flow including a flow component substantially parallel to the first path.

According to another aspect of the present invention, a method of deflecting fluid drops includes providing liquid drops having a plurality of volumes traveling along a first path; providing a first fluid flow operable to interact with the liquid drops thereby causing liquids drops having one of the plurality of volumes to begin moving along a second path; and providing a second fluid flow including a flow component substantially parallel to the first path.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
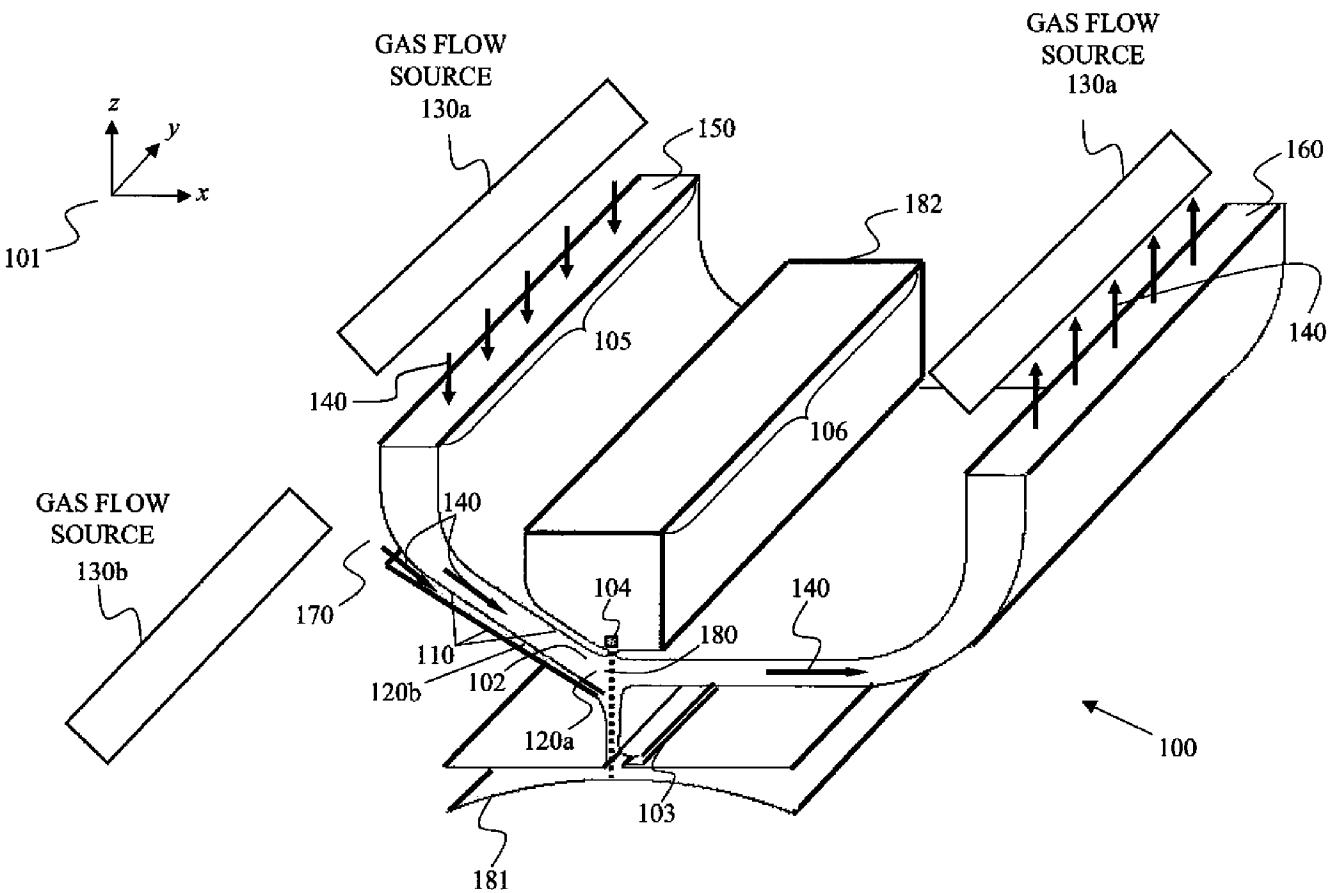
FIG. 1 is a schematic perspective view of a printing system with an example embodiment of the present invention.

The present description will be directed in particular to elements forming part of, or cooperating more directly with, apparatus in accordance with the present invention. It is to be understood that elements not specifically shown or described may take various forms well known to those skilled in the art. The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink.

When present in printing systems, for example, like those commonly referred to as continuous printing systems, turbulence, particularly wall-turbulence in the drop deflector system, is induced mainly by boundary friction (drag on the gas flow, for example, air, exerted by the walls of the drop deflector system of a continuous printing system). Drag and therefore turbulence can be reduced or even eliminated by actively controlling the boundary regions of the system. Boundary regions include, for example, areas of the system where the gas flow is adjacent to a solid portion, for example, a wall, of the system.

Drag reduction is accompanied by reductions in the magnitude of shear stress, commonly referred to as Reynolds shear stress, throughout the gas flow. This also helps to reduce or even eliminate turbulence. For example, when introducing a secondary fluid flow along the primary fluid flow, located along a boundary regions near the drop deflection regions, moving in the same direction and at substantially the same velocity as the velocity of the primary fluid flow, drag can be reduced and the fluid flow, for example, a laminar gas flow, can be maintained in the drop deflector system.

FIG. 1 is a schematic perspective view of a printing system with an example embodiment of the present invention. A Cartesian coordinate system x-y-z 101 is included in FIG. 1 to show the relative orientations of the views demonstrated in the figures hereafter. The printing system 100 includes a liquid drop ejector 104, a gas flow device 102, drop recycle system 103 and medium 181. The liquid drop ejector 104 operable to eject liquid drops has a plurality of volumes along a first path 180. The gas flow device 102 includes a wall or walls 110 that define a first passage 120*a* and a second passage 120*b*. A gas flow source 130*a* is operatively associated with the first passage 120*a* and is operable to cause a first fluid flow to flow in a direction (represented by arrows 140, hereafter) through the first passage 120*a*. The gas flow source 130*a* can be any type of mechanism commonly used to create a gas flow. For example, the gas flow source 130*a* can be a positively pressured fluid flow source such as a fan or a blower operatively associated with an air front side 150 of the first passage 120*a*. Alternatively, the gas flow source 130*a* can be of the type that creates a negative pressure or a vacuum operatively associated with the air backside 160 of the first passage 120*a*. Positioning of the gas flow source 130*a* relative to the first passage 120*a* depends on the type of the gas flow source 130*a* used. For example, when a positively pressured gas flow source 130*a* is used for the first fluid flow, the gas flow source can be located at the front side 150 of the first passage 120*a*. When a negative pressure or a vacuum gas flow source 130*a* is used, the gas flow source 130*a* can be located at the backside 160 of the first passage 120*a*.

A gas flow source 130*b* is operatively associated with the second passage 120*b* and is operable to cause a second fluid flow to flow in a direction (represented by arrows 140) through the second passage 120*b*. The gas flow source 130*b* can be any type of mechanism commonly used to create a gas flow. For example, the gas flow source 130*b* can be a positively pressured flow source such as a fan or a blower operatively associated with an air front side 170 of the second passage 120*b*. It is preferred that the velocity of the first fluid flow in the first passage 120*a* be substantially equal to the velocity of the second fluid flow in the second passage 120*b*. However, the velocity of the first fluid flow in the first passage 120*a* can be different from the velocity of the second fluid flow in the second passage 120*b* depending on the specific embodiments being contemplated. The second fluid flow in the second passage 120*b* includes a flow component substantially parallel to the first path 180. The flow velocities and directions of the second fluid flow in the second passage 120*b* should be fine-tuned to the flow velocities and directions of the first fluid flow in the first passage 120*a*. The match of these velocities and directions may be accomplished by adjusting the angle between the first passage 120*a* and the second passage 120*b*, or the first path 180 or both.

Referring to FIG. 1, the gas of the gas flow source 130*a* and 130*b* can be air, vapor, nitrogen, helium, carbon dioxide, or other, commonly available gases. However, preferred the gas of the gas flow sources 130*a* and 130*b* is air, simply due to economical reasons. The gases of the gas flow source 130*a* and 130*b* can be different, but they are preferred to be the same. Also, the gas flow source 130*a* and the gas flow source 130*b* can be the same, or different. The shape of the walls 110 can be straight or be curved as necessary to match the flow velocity and direction of the first fluid flow in the first passage 120*a* with the flow velocity and direction of the second fluid flow in the second passage 120*b*. The walls 110 can be made from any suitable materials such as aluminum, stainless steel, plastics, glass etc. The surfaces of the wall 110 can be polished to minimize surface roughness to further minimize disturbance to gas flows. The first passage 120*a* and the second passage 120*b* have a width 105 in the y-direction. To eliminate boundary effects, the width of the passage in the y-direction should be wider than the width 106 of the drop ejector 182.

The first fluid flow in the first passage 120*a* is operable to interact with the liquid drops along the first path 180 to cause the liquid drops having one of the plurality of volumes to begin moving along a second path and being recycled through the drop recycle system 103. The second fluid flow in the second passage 120*b* includes a flow component substantially parallel to the first path 180 and facilitates the drops to register onto the medium 181 with precision.

Figure 2A:
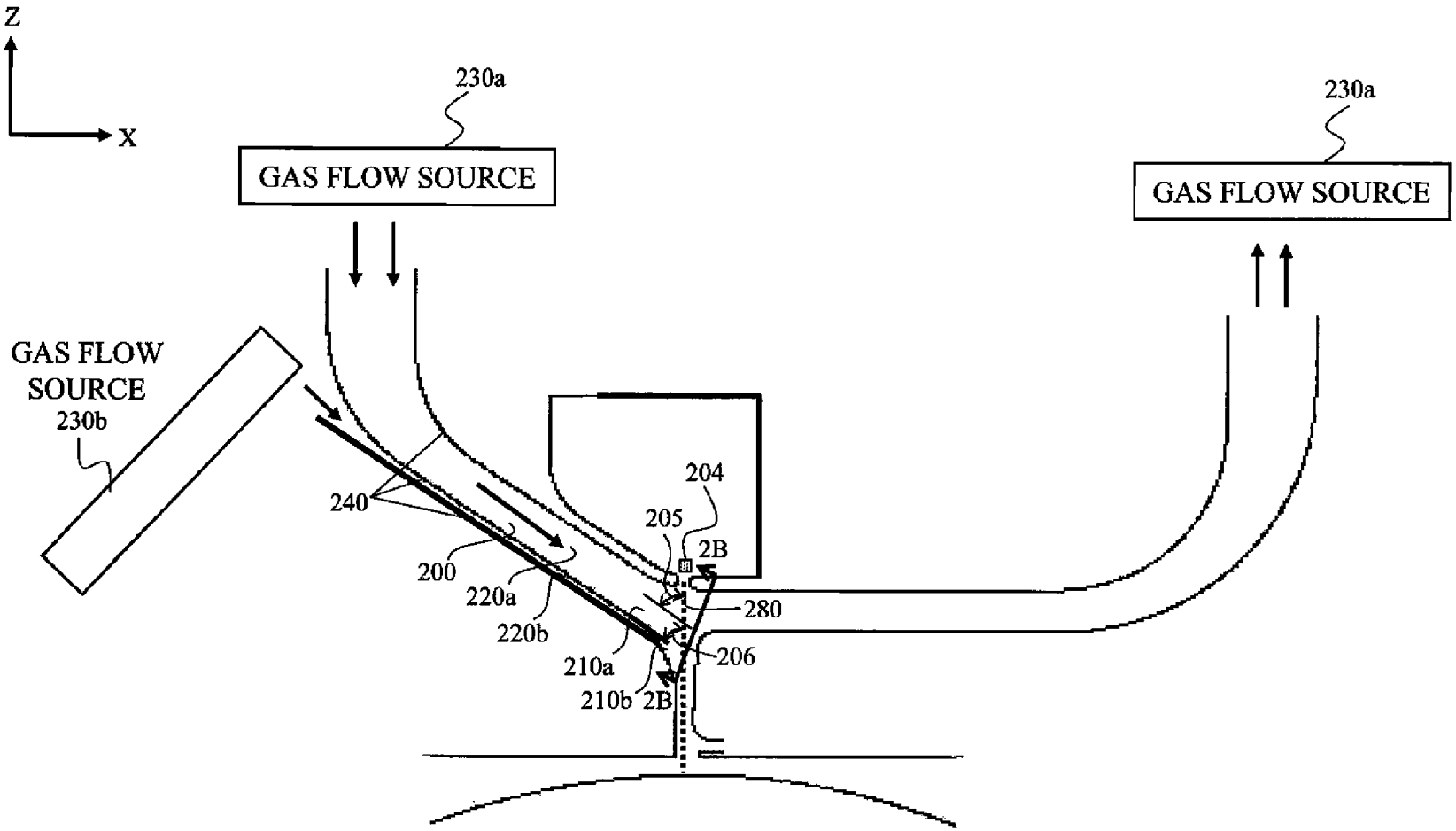
FIG. 2A is a schematic side view of the printing system with the example embodiment of the present invention shown in FIG. 1.

FIG. 2A shows a schematic side view of the printing system shown in FIG. 1. The liquid drop ejector 204 operable to eject liquid drops has a plurality of volumes along a first path 280. The gas flow device 200 includes a wall or walls 240 that define a first passage 220*a* and a second passage 220*b*. A gas flow source 230*a* is operatively associated with the first passage 220*a* and is operable to cause a first fluid flow to flow in a direction along the first passage 220*a*; a gas flow source 230*b* is operatively associated with the second passage 220*b* and is operable to cause a second fluid flow to flow in a direction along the second passage 220*b*. The first passage 220*a* is at a non-perpendicular angle 205 relative to the first path 280; the second passage 220*b* is at a non-perpendicular angle 206 relative to the first path 280. The first passage 220*a* includes an outlet 210*a* positioned proximate to the first passage 220*a*, and the second passage 220*b* includes an outlet 210*b* positioned proximate to the second passage 220*b*. The walls 240 include an outlet 210*a* operatively associated with the gas flow source 230*a* for the first passage 220*a* such that the first fluid flows through the outlet 210*a*. The walls 240 include an outlet 210*b* operatively associated with the gas flow source 230*b* for the second passage 220*b* such that the second fluid flow flows through the outlet 210*b*.

Figure 2B:
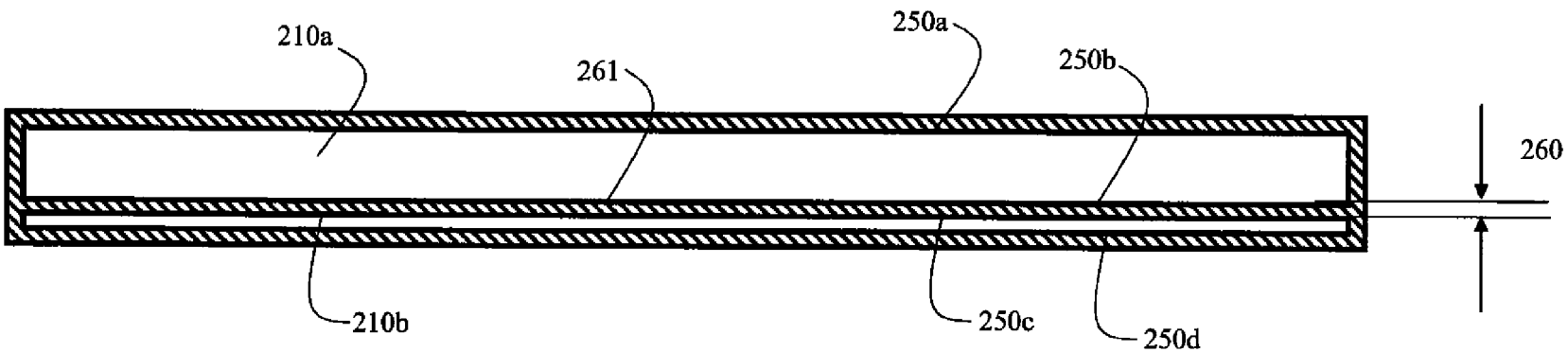
FIG. 2B is a cross sectional view taken along line 2A-2A of the example embodiment shown in FIG. 2A.

FIG. 2B shows a 2B-2B view of the two outlets 210*a* and 210*b* in FIG. 2A. The outlet 210*a* associated with the first passage 220*a* includes two substantially parallel edges 250*a* and 250*b*; the outlet 210*b* associated with the second passage 220*b* includes two substantially parallel edges 250*c* and 250*d*. Edges 250*a*, 250*b*, 250*c* and 250*d* are also substantially parallel. The thickness 260 of the wall 261 between the outlets 210*a* and 210*b* should be thin. It is preferred the edge of the wall 261 at the outlets 210*a* and 210*b* being a knife-edge to eliminate any aerodynamic flow vortices that may be induced by the wall thickness.

Figures 3A, 3B:
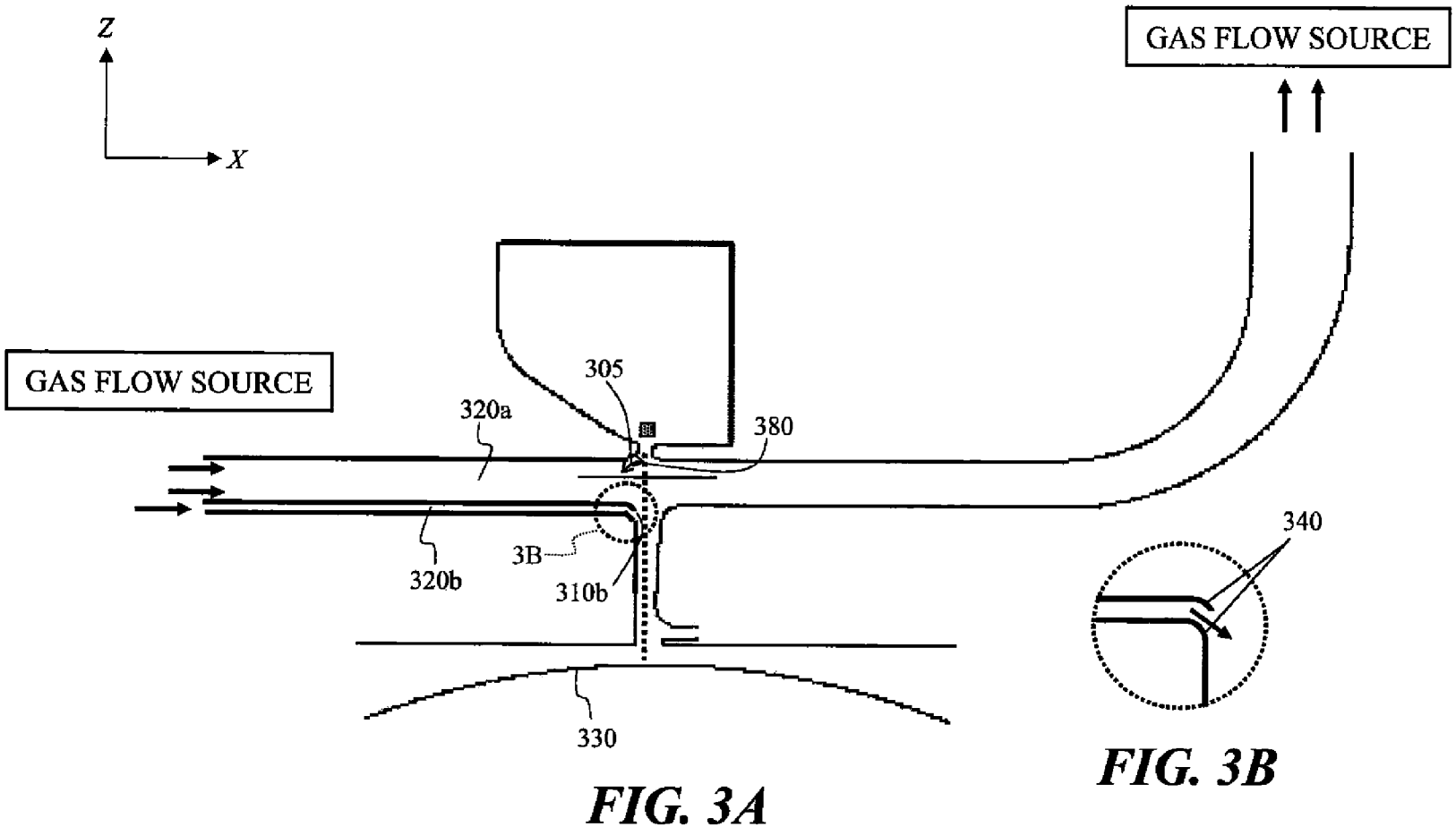
FIG. 3A is a schematic side view of a printing system with another example embodiment of the present invention.
FIG. 3B is a schematic side close-up view of an example embodiment shown in FIG. 3A.

FIG. 3A shows a schematic side view of a printing system with another example embodiment of the present invention. This example embodiment of the present invention is substantially similar to that shown in FIG. 2A; however, the first passage 320*a* is at a perpendicular angle 305 relative to the first path 380 and the second passage 320*b* is at a perpendicular angle relative to the first path 380. To facilitate drop registration on the medium 330, the second fluid flow in the second passage 320*b* includes a flow component substantially parallel to the first path 380. The desired flow pattern for the second fluid flow can be achieved by incorporating curved walls near the outlet 310*b* operatively associated with the second passage 320*b*.

A close-up view of the outlet 310*b* associated with the second passage 320*b* is shown in FIG. 3B. The shape of the walls 340 can control the flow direction of the second fluid flow at the outlet 310*b* associated with the second passage 320*b*. It is preferred that velocity of a component of the second fluid flow parallel to the first passage 320*a* is substantially equal to the flow velocity of the first fluid flow.

Figure 4B:
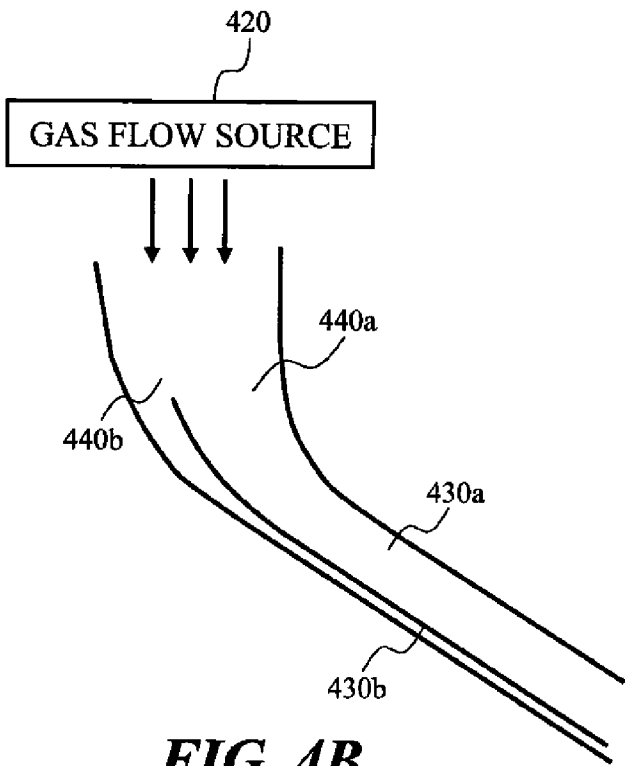
FIG. 4B is a schematic side view of an alternative embodiment of the portion of the example embodiment shown in FIGS. 1, 2A, and 3A.
Figure 4A:
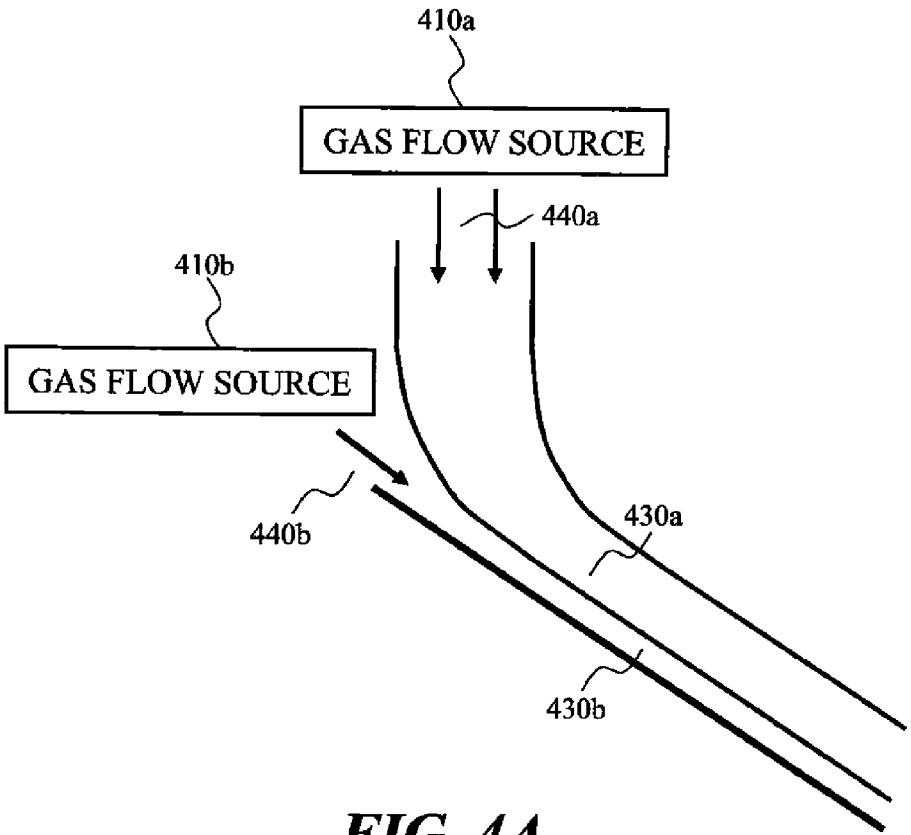
FIG. 4A is a schematic side view of a portion of the example embodiment shown in FIGS. 1, 2A, and 3A.

FIG. 4A is a schematic side view of a portion of another example embodiment of the present invention. A gas flow source 410*a* is operatively associated with the first passage 430*a* operable causes the first fluid flow. A gas flow source 410*b* is operatively associated with the second passage 430*b* operable causes the second fluid flow. The gas flow sources 410*a* and 410*b* can be any type of mechanism commonly used to create a gas flow. For example, the gas flow source can be a positively pressured flow source such as a fan or a blower. The gas flow source 410*a* and the gas flow source 410*b* are two different gas flow sources. The gas of the gas flow sources 410*a* and 410*b* can be air, vapor, nitrogen, helium, carbon dioxide, or other commonly available gases. However, the preferred the gas of the gas flow sources 410*a* and 410*b* is air, simply due to economical reasons. The gases of the two gas flow sources 410*a* and 410*b* can be the same, which is preferred, or can be different.

FIG. 4B is a schematic side view of a portion of another example embodiment of the present invention. A gas flow source 420 is operatively associated with the first passage 430*a* operable to cause the first fluid flow. The same gas flow source 420 is also operatively associated with the second passage 430*b* operable to cause the second fluid flow. The gas flow sources 420 for the first passage 430*a* and the second passage 430*b* are the same source. The gas flow source 420 can be any type of mechanism commonly used to create a gas flow. For example, the gas flow source 420 can be a positively pressured flow source such as a fan or a blower operatively associated with the first passage 430*a* and the second passage 430*b*. The gas of the gas flow source 420 can be air, vapor, nitrogen, helium, carbon dioxide, etc. However, the preferred the gas of the gas flow sources 420 is air, simply due to economical reasons.

Figure 5A:
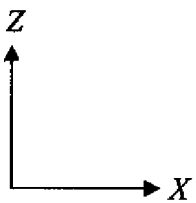
FIG. 5A is a schematic side view of a printing system with an example embodiment of the present invention.
Figure 5A:
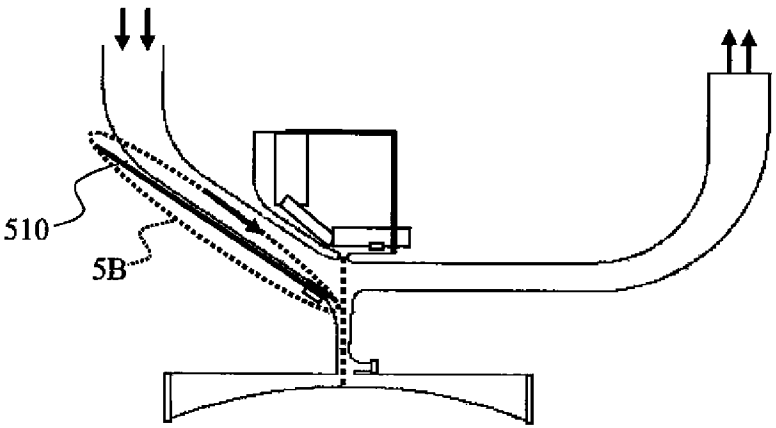
Figure 5B:
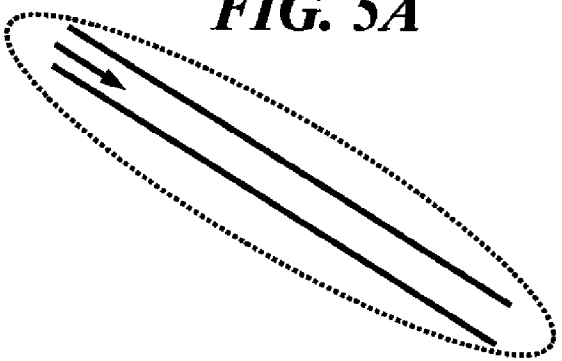
FIG. 5B is a schematic side view of a portion of the example embodiment shown in FIG. 5A.

FIG. 5A is a schematic side view of a printing system with another example embodiment of the present invention. Referring to FIG. 5A, the second passage 510 has a width and a length. The width of the second passage 510 at one location along the length is the same as the width of the second passage 510 at another location along the passage. FIG. 5B is a close-up side view of the second passage 510.

Figure 6A:
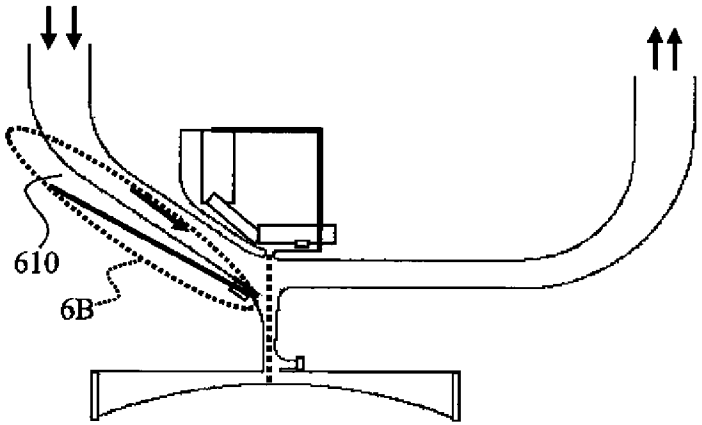
FIG. 6A is a schematic side view of a printing system with another example embodiment of the present invention.
Figure 6B:
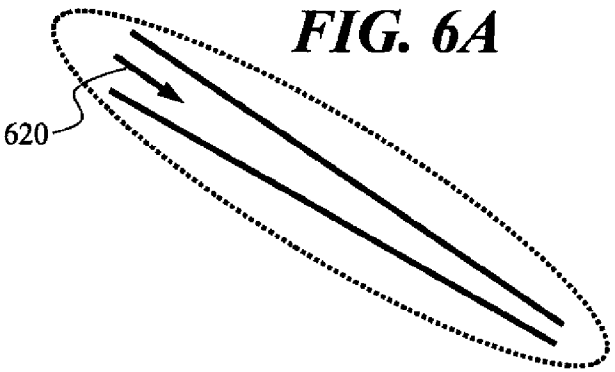
FIG. 6B is a schematic side view of a portion of the example embodiment shown in FIG. 6A.

FIG. 6A is a schematic side view of a printing system with another example embodiment of the present invention. The second passage 610 has a width and a length. Referring to FIG. 6A the width of the second passage 610 at one location along the length is different from the width of the second passage at another location along the passage. FIG. 6B is a close-up side view of the second passage 610, which shows along the second fluid flow direction 620, the width of the second passage 610 is tapering. Examples of some these types of devices are described in U.S. patent application Ser. No. 11/744,987.

Figures 7A, 7B:
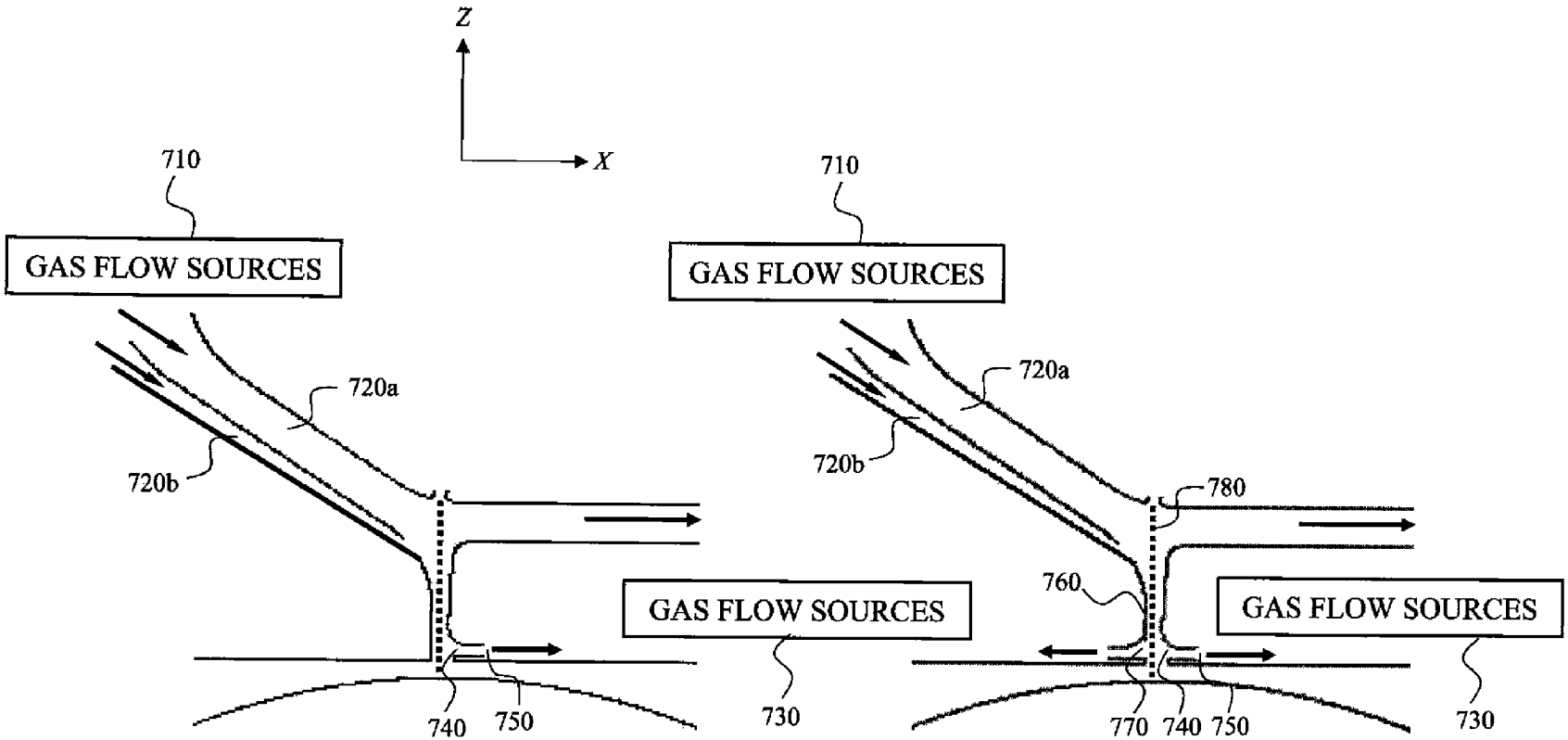
FIG. 7A is a schematic side view of a printing system with another example embodiment of the present invention.
FIG. 7B is a schematic side view of a printing system with another example embodiment of the present invention.

FIG. 7A is schematic side view of a printing system with another example embodiment of the present invention. The flow system includes a gas flow sources 710 operable to cause the first fluid flow flows in the first passage 720*a*, causes the second fluid flow flows in the second passage 720*b*. An opening 740 is operatively associated to the inlet of the drop recycle system 750. A gas flow source 730 is operatively associated to the drop recycle system to cause a fluid flow flows through the opening 740. The gas flow source can be any type of mechanism commonly used to create a negative pressure or a vacuum.

FIG. 7B is schematic side view of a printing system with another example embodiment of the present invention. FIG. 7B is similar with FIG. 7A. The flow system includes a gas flow sources 710 operable to cause the first fluid flow flows in the first passage 720*a*, causes the second fluid flow flows in the second passage 720*b*. An opening 740 is operatively associated to the inlet of the drop recycle system 750. A gas flow source 730 is operatively associated to the drop recycle system to cause a fluid flow flows through the opening 740. A wall 760 positioned proximate to the first path 780. The wall 760 includes an opening 770 operatively associated with a gas flow source 730. The gas flow source 730 operable to cause a fluid flow to flow through the opening 770. The gas flow source 730 can be any type of mechanism commonly used to create a negative pressure or a vacuum. Referring to FIG. 7B, the gas flow sources 730 to cause the fluid flow through opening 740 and opening 770 can be the same gas flow source or the different gas flow sources.

Figures 8A, 8B:
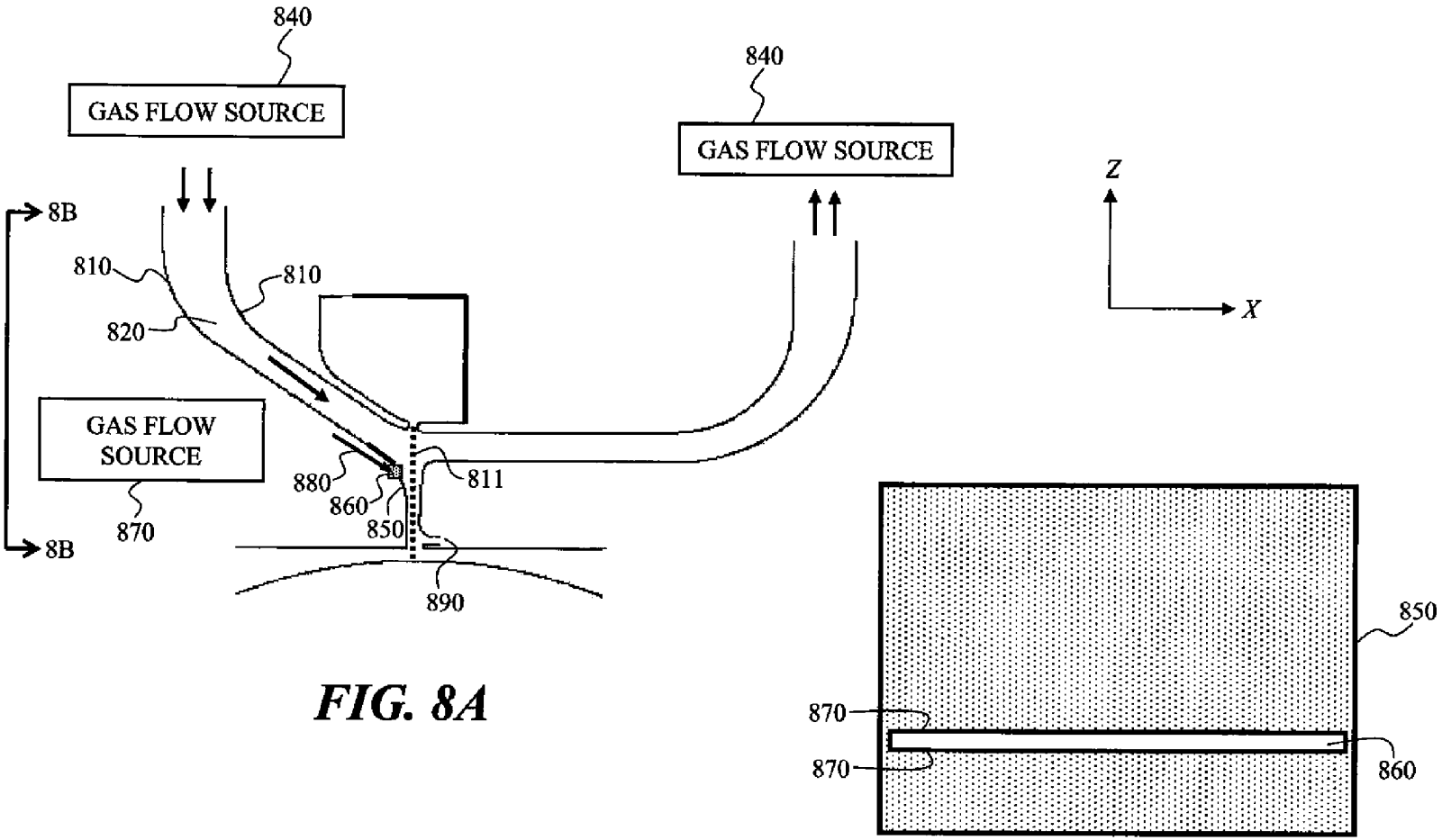
FIG. 8A is a schematic side view of a printing system with another example embodiment of the present invention.
FIG. 8B is a cross sectional view taken along line 8B-8B of the example embodiment shown in FIG. 8A.

FIG. 8A is a schematic side view of a printing system with another example embodiment of the present invention. The gas flow device includes walls 810 that define a first passage 820. A gas flow source 840 is operatively associated with the first passage 820 and is operable to cause a first fluid flow to flow in a direction along the first passage 820. A wall 850 positioned proximate to the first path 811. The wall 850 includes an opening 860 operatively associated with a fluid flow source 870 for the second fluid flow 880 such that the second fluid flow flows through the opening 860.

FIG. 8B shows a view taken along line 8B-8B of the example embodiment shown in FIG. 8A. The opening 860 includes two substantially parallel edges 870. The gas flow source 840 can be any type of mechanism commonly used to create a gas flow. For example, gas flow source 840 can be a positively pressured flow source such as a fan or a blower operatively associated with the first passage 820. Alternatively, the gas flow source 840 can be of the type that creates a negative pressure or a vacuum operatively associated with the first passage 820. The gas flow source 870 for the second fluid flow 880 can also be any type of mechanism commonly used to create a gas flow. For example, the gas flow source 870 can be a positively pressured gas tank operatively associated with the opening 860; Alternatively, the gas flow source 870 can be of the type that creates a negative pressure or a vacuum operatively associated with the drop recycle system 890. It is preferred that the velocity of the gas flow in the first passage 820 be substantially equal to the velocity of the gas flow flowing through the opening 860. However, the velocity of the gas flow in the first passage 820 can be different from the velocity of the gas flow flowing through the opening 860. The second fluid flow includes a flow component substantially parallel to the first path 811. The gases of the gas flow source can be air, vapor, nitrogen, helium or carbon dioxide etc. However, the gas is preferred to be air. Theoretically, the gas of the gas flow source 840 and the gas of the gas flow source 870 can be different; practically, the gas of the gas flow source 840 and the gas of the gas flow source 870 are preferred to be the same.

The invention has been described in detail with particular reference to certain preferred embodiments thereof, but it will be understood that variations and modifications can be effected within the scope of the invention.

PARTS LIST

100 printing system
101 Cartesian coordinate system x-y-z
102 gas flow device
103 drop recycle system
104 liquid drop ejector
105 width
106 width
110 walls
120*a* first passage
120*b* second passage
130*a* gas flow source
130*b* gas flow source
140 arrows
150 air front side
160 air backside
170 air front side
180 first path
181 medium
182 drop ejector
200 gas flow device
204 liquid drop ejector
205 non-perpendicular angle
206 non-perpendicular angle
210*a* two outlets
210*b* two outlets
220*a* first passage
220*b* second passage
230*a* gas flow source
230*b* gas flow source
240 walls
250*a* two substantially parallel edges
250*b* two substantially parallel edges
250*c* two substantially parallel edges
250*d* two substantially parallel edges
260 thickness
261 wall
280 first path
305 perpendicular angle
320*a* first passage
320*b* second passage
330 medium
340 walls
380 first path
410*a* gas flow source
410*b* gas flow source
420 gas flow source
430*a* first passage
430*b* second passage
510 second passage
610 second passage
620 second fluid flow direction
710 gas flow sources
720*a* first passage
720*b* second passage
730 gas flow source
740 opening
750 drop recycle system
760 wall
770 opening
780 first path
810 walls
811 first path
820 first passage
840 gas flow source
850 wall
860 opening
870 fluid flow source
880 second fluid flow
890 drop recycle system

The invention claimed is:

1. A printing system comprising:

a liquid drop ejector operable to eject liquid drops having a plurality of volumes along a first path;

a fluid flow source operable to produce a first fluid flow, the first fluid flow being operable to interact with the liquid drops to cause liquids drops having one of the plurality of volumes to begin moving along a second path; and a fluid flow source operable to produce a second fluid flow, the second fluid flow including a flow component substantially parallel to the first path, the first fluid flow and the second fluid flow moving in the same direction.

2. The system of claim 1, wherein the first fluid is a gas.

3. The system of claim 2, wherein the second fluid is a gas, the gas being the same as that of the first fluid.

4. The system of claim 3, wherein the fluid source for the first fluid and the fluid source for the second fluid are the same fluid source.

5. The system of claim 1, wherein the first fluid flow is at a non-perpendicular angle relative to the first path.

6. The system of claim 1, wherein the second fluid flow is at a non-perpendicular angle relative to the first path.

7. The system of claim 1, further comprising:

a first passage operatively associated with the fluid flow source for the first fluid; and a second passage operatively associated with the fluid flow source for the second fluid such that the first fluid flows though the first passage and the second fluid flows through the second passage.

8. The system of claim 7, wherein the first passage is positioned at a non-perpendicular angle relative to the first path.

9. The system of claim 7, wherein the second passage is positioned at a non-perpendicular angle relative to the first path.

10. The system of claim 9, wherein the first passage is positioned at a perpendicular angle relative to the first path.

11. The system of claim 7, the second passage having a width and a length, wherein the width of the second passage at one location along the length is different from the width of the second passage at another location along the length.

12. The system of claim 7, wherein the fluid source for the first fluid and the fluid source for the second fluid are the same fluid source.

13. The system of claim 7, the first passage including an outlet positioned proximate to the first paths the outlet including two substantially parallel edges.

14. The system of claim 7, the second passage including an outlet positioned proximate to the first path, the outlet including two substantially parallel edges.

15. The system of claim 7, the first passage including an opening, the second passage including an opening, wherein the opening of the first fluid passage is parallel to the opening of the second fluid passage.

16. The system of claim 1, further comprising:

a wall positioned proximate to the first path, the wall including an opening operatively associated with the fluid flow source for the second fluid such that the second fluid flows through the opening.

17. The system of claim 1, wherein the fluid source for the first fluid and the fluid source for the second fluid are the same fluid source.

18. The system of claim 1, wherein the fluid flow source operable to produce the first fluid flow includes one of a positive pressure flow device, a negative pressure flow device, and combinations thereof.

19. The system of claim 1, wherein the fluid flow source operable to produce the second fluid flow includes one of a positive pressure flow device, a negative pressure flow device, and combinations thereof.

20. The system of claim 1, wherein the second fluid flow travels at a velocity that is substantially equal to a velocity of the first fluid flow.

21. A method of printing comprising:

providing liquid drops having a plurality of volumes traveling along a first path;

providing a first fluid flow and a second fluid flow including a flow component substantially parallel to the first path, the first fluid flow and the second fluid flow moving in the same direction; and causing the first fluid flow to interact with the liquid drops such that liquids drops having one of the plurality of volumes to begin moving along a second path.

22. The method of claim 21, further comprising:

collecting the liquids drops having one of the plurality of volumes in a catcher while allowing liquid drops having another of the plurality of volumes to contact a receiver.

23. The method of claim 21, wherein providing the first fluid flow and the second fluid flow includes providing the second fluid flow at a velocity that is substantially equal to a velocity of the first fluid flow.

24. A method of printing comprising:

providing liquid drops having a plurality of volumes traveling along a first path;

providing a first fluid flow and a second fluid flow including a flow component substantially parallel to the first path; and causing the first fluid flow to interact with the liquid drops such that liquids drops having one of the plurality of volumes to begin moving along a second path, wherein providing the first fluid flow and the second fluid flow includes providing the second fluid flow at a velocity that is substantially equal to a velocity of the first fluid flow.

25. A printing system comprising:

a liquid drop ejector operable to eject liquid drops having a plurality of volumes along a first path;

a first fluid passage;

a fluid flow source operable to produce a first fluid flow that interacts with the liquid drops to cause liquid drops having one of the plurality of volumes to begin moving along a second path, the fluid flow source for the first fluid being associated with the first fluid passage such that the first fluid flows through the first passage;

a second fluid passage; and a fluid flow source operable to produce a second fluid flow that includes a flow component that is substantially parallel to the first path, the fluid flow source for the second fluid being associated with the second fluid passage such that the second fluid flows through the second passage, wherein the first passage is positioned at a non-perpendicular angle relative to the first path.

26. A printing system comprising:

a liquid drop ejector operable to eject liquid drops having a plurality of volumes along a first path;

a first fluid passage;

a fluid flow source operable to produce a first fluid flow that interacts with the liquid drops to cause liquid drops having one of the plurality of volumes to begin moving along a second path, the fluid flow source for the first fluid being associated with the first fluid passage such that the first fluid flows through the first passage;

a second fluid passage; and a fluid flow source operable to produce a second fluid flow that includes a flow component that is substantially parallel to the first path, the fluid flow source for the second fluid being associated with the second fluid passage such that the second fluid flows through the second passage, wherein the second passage is positioned at a non-perpendicular angle relative to the first path.

27. The system of claim 26, wherein the first passage is positioned at a perpendicular angle relative to the first path.

28. A printing system comprising:

a liquid drop ejector operable to eject liquid drops having a plurality of volumes along a first path;

a first fluid passage;

a fluid flow source operable to produce a first fluid flow that interacts with the liquid drops to cause liquid drops having one of the plurality of volumes to begin moving along a second path, the fluid flow source for the first fluid being associated with the first fluid passage such that the first fluid flows through the first passage;

a second fluid passage; and a fluid flow source operable to produce a second fluid flow that includes a flow component that is substantially parallel to the first path, the fluid flow source for the second fluid being associated with the second fluid passage such that the second fluid flows through the second passage, the second passage having a width and a length, wherein the width of the second passage at one location along the length is different from the width of the second passage at another location along the length.

29. A printing system comprising:

a liquid drop ejector operable to eject liquid drops having a plurality of volumes along a first path;

a fluid flow source operable to produce a first fluid flow, the first fluid flow being operable to interact with the liquid drops to cause liquid drops having one of the plurality of volumes to begin moving along a second path; and a fluid flow source operable to produce a second fluid flow, the second fluid flow including a flow component substantially parallel to the first path, wherein the fluid flow source operable to produce the first fluid flow includes one of a positive pressure flow device, a negative pressure flow device, and combinations thereof.

30. A printing system comprising:

a liquid drop ejector operable to eject liquid drops having a plurality of volumes along a first path;

a fluid flow source operable to produce a first fluid flow, the first fluid flow being operable to interact with the liquid drops to cause liquid drops having one of the plurality of volumes to begin moving along a second path; and a fluid flow source operable to produce a second fluid flow, the second fluid flow including a flow component substantially parallel to the first path, wherein the fluid flow source operable to produce the second fluid flow includes one of a positive pressure flow device, a negative pressure flow device, and combinations thereof.

* * * * *